United States Patent [19]

Swenson et al.

[11] Patent Number: 4,718,982

[45] Date of Patent: Jan. 12, 1988

[54] DENSIFICATION AND HEAT TREATMENT OF PAPERBOARD PRODUCED FROM SCMP AND OTHER SULFITE PULPS

[75] Inventors: Roy S. Swenson, Ringwood, N.J.; F. Keith Hall, Tuxedo Park, N.Y.; Donald M. MacDonald, Monroe, N.Y.; Michael Ring, Warwick, N.Y.

[73] Assignee: International Paper Company, Purchase, N.Y.

[21] Appl. No.: 768,598

[22] Filed: Aug. 23, 1985

[51] Int. Cl.[4] ..... D21F 11/00

[52] U.S. Cl. ..... 162/206; 162/142; 162/150

[58] Field of Search ..... 162/73, 28, 100, 206, 162/207, 150, 142

[56] References Cited

U.S. PATENT DOCUMENTS

| | | | |
|---|---|---|---|
| 2,116,544 | 5/1938 | Schur . | |
| 2,120,137 | 6/1938 | Mason . | |
| 2,802,403 | 8/1957 | Boehm . | |
| 3,319,352 | 5/1967 | Haigh | 162/206 |
| 3,354,035 | 11/1967 | Gottwald et al. . | |
| 3,531,371 | 9/1970 | Jordansson et al. . | |
| 3,533,906 | 10/1970 | Reiniger . | |
| 3,560,297 | 2/1971 | Back et al. . | |
| 3,677,850 | 7/1972 | Holt et al. . | |
| 3,875,680 | 4/1975 | Back et al. . | |
| 3,880,975 | 4/1975 | Lundmark . | |
| 4,032,394 | 6/1977 | Back . | |
| 4,116,758 | 9/1978 | Ford et al. | 162/28 |
| 4,145,246 | 3/1979 | Goheen et al. | 162/142 |
| 4,385,172 | 5/1983 | Yasnovsky et al. . | |
| 4,391,670 | 7/1983 | Phillips | 162/206 |

FOREIGN PATENT DOCUMENTS

| | | | |
|---|---|---|---|
| 1424682 | 2/1976 | United Kingdom | 162/206 |

OTHER PUBLICATIONS

Casey, "Pulp and Paper", 3rd ed., vol. III, (1981), pp. 1620 & 1626.

Anderson & Back, "The Effect of Single Nip Press Drying . . . ", Pulp & Paper, Canada, vol. 77, No. 12, pp. 82–87 (1976).

Back et al., "Wet Stiffness by Heat Treatment of the Running Web", Pulp & Paper Canada, vol. 77, No. 12, pp. 97–106 (1976).

Back et al., "Wet Stiffness by Means of Heat Treatment of Running Web", Pulp & Paper, Canada, vol. 78, No. 11, pp. 111–115 (1977).

Back et al., "Bonding in Paper Webs at Water Deficient Conditions", 1978—place of publication unknown.

Back et al., "Multistage Press Drying of Paper", reprint from Svensk Papperstidning, No. 2–197982 (1979), pp. 35–39.

Back, "The Relative Moisture Sensitivity of Compression . . . ", paper presented Oct. 1985 to Oxford Fundamental Research Symposium.

Seth et al., "The Effect of Press-Drying on Paper Strength", 1985 Papermakers Conference, pp. 249–256.

Setterholm et al., "Variables in Press Drying Pulps from Sweetgum an Red Oak", USDA For. Serv. Res. Paper FPL 295 (1977).

Setterholm, "An Overview of Press Drying", Tappi Journal, vol. 62, No. 3, pp. 46–56 (1979).

Norberg & Back, "Effect of Hot Pressing Temperature on the Properties of Hard and Semi-Hard Fibre Building Boards", Svensk Papperstidning, vol. 71, No. 15, pp. 774–787 (1968).

Back et al., "The Present State of Press-Drying of Paper", Paper for 7th Fundamental Research Symposium (1981).

(List continued on next page.)

*Primary Examiner*—Peter Chin

*Attorney, Agent, or Firm*—Walt Thomas Zielinski; Charles W. Fallow

[57] ABSTRACT

Both the wet strength and the folding endurance of SCMP and sulfite paperboard are improved by subjecting the board to steps of densification and high temperature treatment during its production.

10 Claims, 2 Drawing Figures

OTHER PUBLICATIONS

Anderson and Back, untitled paper presented at European Conference (Oct. 1977).

Back, "Some Effects of Short Hot Press Nips on Wet Webs", date and place of publication unknown.

Back, "The Effect of Press Drying on Properties of Liner of High Yield Pulp", date and place of publication unknown.

Back et al., "The Dry, Hot Mouldability of Hardboard", Forest Products Journal, vol. 21, No. 9, pp. 96–100 (1971).

Back et al., "Bond in Paper Webs Under Water-Deficient Conditions", Tappi Journal, vol. 62, No. 3, pp. 89–92 (1979).

Pease et al., "An Investigation into the Effects of High Pressure Wet Pressing . . . Tappi Journal, vol. 45, No. 7, pp. 150-153A (1962).

Stenberg, "Effect of Heat Treatment on the Internal Bonding of Kraft Liner", Svensk Papperstidning, No. 2, pp. 49–54 (1978).

Fraser, "Hot 'Mangle' Presses Thick Particleboard in Continuous Ribbon . . . ", date and place of publication unknown.

Setterholm et al., "Press Drying of High-Yield Hardwood Pulp", Criteria for Fiber Product Design (FS-F-PL-3306) (1976).

DENSIFICATION AND HEAT TREATMENT OF PAPERBOARD PRODUCED FROM SCMP AND OTHER SULFITE PULPS

BACKGROUND OF THE INVENTION

1. Field of the Invention

This invention relates to the art of papermaking, particularly to treating paperboard produced from SCMP and sulfite pulps with pressure and heat to improve its wet strength while preserving its folding endurance.

2. Description of the Prior Art

The semichemical mechanical pulping process is a method of production of an aqueous slurry of fibers by treatment of a suitable renewable raw material. In most pulping processes, a considerable portion of the natural natural lignin in wood, grass or other vegetative matter is rendered soluble by chemical reaction with one or more nucleophilic reagents. Minimization of the lignin portion solubilized and removed whilst so altering the lignin as to permit recovery of fibers by the mechanical action of a disk or other refiner or shredder in a condition of little damage is the goal of the SCMP process. It is also the goal of certain related processes known as the chemimechanical process (CMP), the chemithermomechanical process (CT-MP) and the neutral sulfite semichemical (NSSC) processes. Such pulps are normally considered to be more brittle and of inferior strength when compared to lower lignin pulps produced by the kraft, sulfite, kraft-anthraquinone (AQ), soda-AQ or alkaline sulfite AQ processes. However, properties are adequate for many end-uses, including corrugated medium and even as a linerboard component. Such pulps gain wet strength, without the severe enhancement of brittleness that is caused by heat treatment alone, if densified before or during the heat treatment.

In the sulfite process, sulfite or bisulfite ion is the nucleophilic agent. The sulfite or bisulfite ions cause the lignin molecules to break into small fragments. During this chemical reaction, the sulfite or bisulfite ions become chemically bonded to the lignin fragments thereby providing water solubility. A variation of the sulfite process involves the use of anthraquinone (AQ) or substituted anthraquinones as a second nucleophile. AQ is reduced in situ during the earliest stages of the cook to anthrahydroquinone (AHQ). As AQ is insoluble and only the salt from of AHQ is soluble, alkali presence is necessary for solution formation and uniform penetration of AQ into the wood chip, grass stem or any other fiber-containing vegetative matter. Such a cooking process is known as an alkaline sulfite-AQ process. Both the sulfite process and the alkaline sulfite-AQ variation of the sulfite process are well known to the industry and pulps thus prepared can be used to give the benefits of our invention.

In the art of making SCMP linerboard, it is conventional to subject felted fibers to wet pressing to unite the fibers into a coherent sheet. Pressure is typically applied to a continuous running web of paper by a series of nip rolls which, by compressing the sheet, both increase its volumetric density and reduce its water content. The accompanying FIG. 1 shows in simplified diagrammatic form a typical papermaking machine, including a web former and three representative pairs of wet press rolls. Also shown are drying rolls whose purpose is to dry the paper to a desired final moisture content, and a calendar stack to produce a smooth finish. At least some of the rolls are ordinarily heated to hasten drying. (The drawing is simplified—there many more drying rolls in actual practice.)

There is currently considerable interest in treatments involving heat and pressure, or heat alone, during or after the production process, to improve various qualities of paperboard. Quantifiable board qualities include dry tensile strength, wet tensile strength, reverse folding endurance, compressive strength and stiffness, among others. Which qualities should desirably be enhanced depends upon the intended application of the product. For linerboard to be used in manufacturing corrugated cartons for use in humid or wet environments, three qualities of particular interest are wet strength, folding endurance and high humidity compression strength, all of which can be measured by well-known standared tests. As used herein, then, "wet strength" means wet tensile strength as measured by American Society for Testing and Materials (ASTM) Standard D829-48. "Folding endurance" is defined as the number of times a board can be folded in two directions without breaking, under conditions specified in Standard D2176-69. "Basis weight" is the weight per unit area of the dried end product.

Prior workers in this field have recognized that high-temperature treatment of linerboard can improve its wet strength. See, for example E. Back, "Wet stiffness by heat treatment of the running web", *Pulp & Paper Canada,* vol. 77, No. 12, pp. 97–106 (December 1976). This increase has been attributed to the development and cross-linking of naturally occurring polysaccharides and other polymers, which phenomenon may be sufficient to preserve product wet strength even where conventional synthetic formaldehyde resins or other binders are entirely omitted.

It is important to note that wet strength improvement by heat curing has previously been thought attainable only at the price of increased brittleness (i.e., reduced folding endurance). Therefore, most prior high-temperature treatments have been performed on particle board, wallboard, and other products not to be subjected to flexure. The known processes, if applied to paperboard, would produce a brittle product. Embrittled paperboard is not acceptable for many applications involving subsequent deformation such as the converting operation on a corrugating machine to make corrugated boxes out of linerboard, and therefore heat treatment alone, to develop wet strength of linerboard, has not gained widespread acceptance. As Dr. Back has pointed out in the article cited above, "The heat treatment conditions must be selected to balance the desirable increase in wet stiffness against the simultaneous embrittlement in dry climates." Significantly, in U.S. Pat. No. 3,875,680, Dr. Back has disclosed a process for heat treating already manufactured corrugated board to set previously placed resins, the specific purpose being to avoid running embrittled material through a corrugator.

It is plain that added wet strength and improved folding endurance were previously thought incompatible results.

It is therefore an object of the invention to produce paperboard having both greatly improved wet strength and good folding endurance. Another goal is to achieve that objective without resorting to synthetic resins or other added binders and wet strength agents.

With a view to the foregoing, a process has been developed which dramatically and unexpectedly increases not only the wet strength of paperboard, but also preserves its folding endurance. In its broadest sense, the invention comprises steps of (1) subjecting paperboard produced from SCMP pulp to high pressure densification, and (2) heating the board to an internal temperature of at least 420° F. (216° C.) for a period of time sufficient to increase the wet strength of the board.

This method produces a product having folding endurance greatly exceeding that of similar board whose wet strength has been increased by heat alone. This is clearly shown by our tests exemplified below.

While the tests set out in Examples 1–2 have carried out the invention in a static press, it is preferred that the heat and pressure be applied to continuously running board by hot pressure rolls inasmuch as much higher production rates can be attained.

We prefer to raise the internal temperature of the board to at least 450° F. (232° C.), as greater wet strength is then achieved. This may be because at higher temperatures, shorter step duration is necessary to develop bonding, and there is consequently less time for fiber degradation to occur. Also, shorter durations enable one to achieve higher production speeds.

It should be noted that the heating rate, and thus the required heating duration at a particular temperature, depends on method of heat transfer chosen. Furthermore, it is desirable to raise the web temperature as rapidly as possible to the chosen treating temperature. Improved heating rates can be achieved by using high roll temperatures and/or by applying high nip forces to the press roll against the sheet on the hot rolls. That high pressure dramatically improves heat transfer rates has previously been disclosed. One worker has attributed this to the prevention of vapor formation at the web-roll interface.

While the invention may be practiced over a range of temperatures, pressures and durations, these factors are interrelated. For example, the use of higher temperatures requires a heating step of shorter duration, and vice-versa. At 450° F., a duration of 5 seconds has been found sufficient to obtain substantial improvements, while at lower temperature, considerably longer time is required to achieve the same improvement.

It is presently preferred that, for safety reasons, the roll temperature be not greater than the web ignition temperature (572° F., 300° C.); however, even higher roll temperatures may be used if suitable precautions, such as the provision of an inert atmosphere, or rapid removal of paper from the hot environment, are taken.

DESCRIPTION OF THE PREFERRED EMBODIMENT

Figure 1:
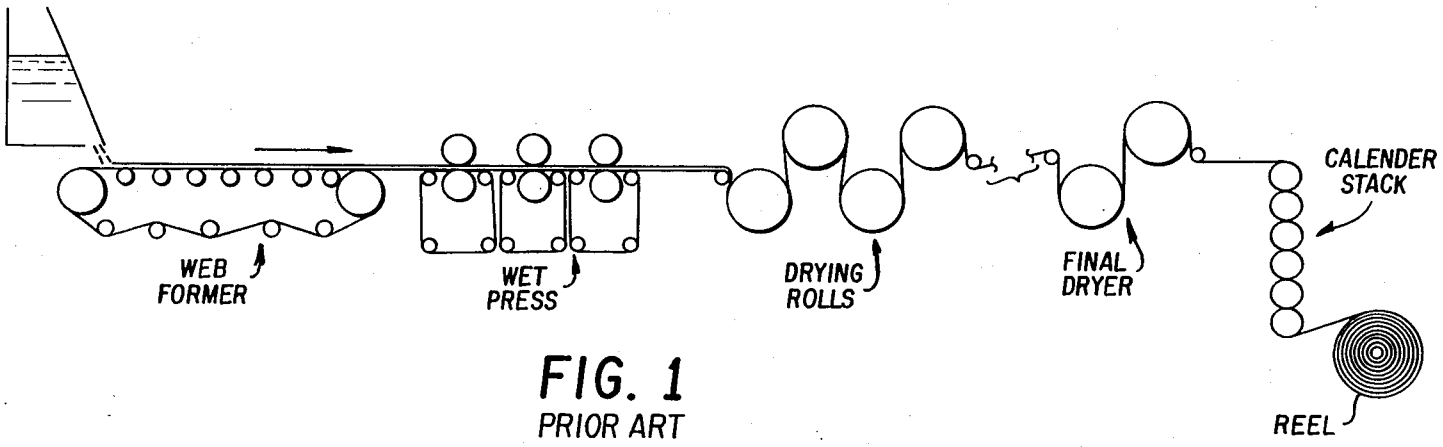
FIG. 1 PRIOR ART
FIG. 1 shows, in greatly simplified diagrammatic form, a conventional apparatus for producing paperboard.
Figure 2:
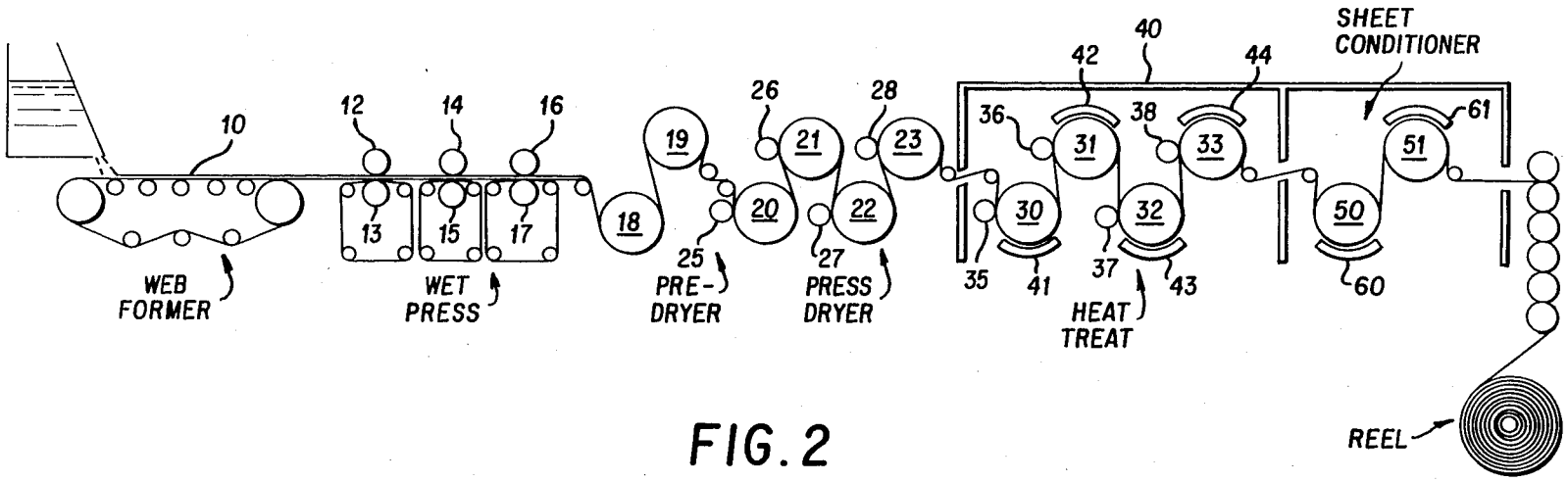
FIG. 2 shows, in like diagrammatic form, an apparatus for practicing the present invention.

FIG. 2 illustrates a preferred apparatus for carrying out the inventive process, although it should be understood that other devices, such as platen presses, can be used and in fact some of the data below was obtained from platen press tests. In the machine depicted, SCMP or sulfite pulp fibers in aqueous suspension are deposited on a web former screen 10, producing a wet mat of fibers. The mat is then passed through a series of wet press nip rolls 12, 13, 14, 15, 16 and 17 which develop a consolidated web. Suitable wet presses known today include long nip presses and shoe-type presses capable of developing high unit press pressures on the wet fiber web. This step is known as "high pressure wet pressing". The web is then passed over pre-drying rolls 18, 19 to remove water from the wet web. Once the moisture content of the web has been reduced to less than 70% by weight, high pressure densification and high temperature treatment are applied in accordance with the invention.

To densify the web, a series of drying rolls 20, 21, 22, 23 are provided with respective pressure rollers 25, 26, 27, 28 which are loaded sufficiently to produce a web density of at least 700 kg/m$^3$. We define this step as "press drying". In the preferred embodiment, the high pressure densification step of the invention is carried out both at normal drying temperatures (substantially below 400° F.) in the press drying section, and also in the high temperature heat treatment section described below. It should be understood, however, that the two steps may be performed sequentially or simultaneously.

In the heat treatment section, one or more drying rolls (e.g. 30, 31, 32, 33) is heated to or slightly above the desired maximum internal web temperature. Pressure rolls 35, 36, 37, 38 are used to improve heat transfer between the drying rolls and the web, and preferably, these pressure rolls are also highly loaded to continue the high pressure densification step during heat treatment. The drying roll temperature necessary to achieve target web temperature is a function of several factors including web thickness, web moisture, web entering temperature, web speed, nip pressure, and roll diameter; its calculation is within the skill of the art. It is presently believed optimum to achieve an internal web temperature of 450° F. (232° C.) and to maintain such temperature for five seconds. In any event, the roll temperature must be at least 420° F. (221° C.) which is well in excess of the temperature of normal drying rolls. The heat treatment rolls are contained within an envelope 40, and air caps 41, 42, 43, 44 may be used to heat the web further as it passes over each roll. An inert gas, steam or superheated steam can be used for this purpose, and to prevent oxidation or combustion at high temperatures.

Following heat treatment, the web may be passed over final drying rolls 50, 51 having air caps 60, 61. It is then calendered and reeled in a conventional manner.

The combined effect of high pressure densification and high temperature produce an unexpected combination of good wet strength and good folding endurance in the finished product.

The invention has been practiced as described in the following examples. The improvement in board quality will be apparent from an examination of the test results listed in the tables below.

EXAMPLE 1

A mixture of spruce and fir wood chips was cooked by the SCMP process to a yield of 92% by weight of dry chips. The cooked chips were converted to a pulp by passage through a disk refiner. The pulp was washed with water to remove residual cooking chemical and solubilized material. Latency removal was accomplished by stirring at 4% consistency for 20 minutes at 85°–90° C. Pulp freeness was 705 ml by the Canadian Standard Freeness Test.

A dispersion of the pulp in distilled water was converted to handsheets using a TAPPI sheet mold. The quantity of fiber in the slurry fed to the mold was adjusted to give a basis weight of 42 lb/1000 ft$^2$ (205 g/m$^2$) in the oven dried state.

Two sets of sheets were prepared. Sheets from the first set were dried on TAPPI rings at room temperature after wet pressing. Wet pressing and drying were in accordance with the procedure in TAPPI T-205 om-81. Sheets from the second set were placed between two 150 mesh stainless steel screens and pressed in a platen press at 300 psi (2067 kPa) and 450° F. (232° C.) platen temperature for different times between 5 and 60 seconds. This drying procedure effectively combines the densification and heat treatment stages and is known as high temperature press drying (HTPD). All sheets were conditioned at 73° F. (22.5° C.) and 50% humidity for at least 48 hours before testing.

Folding endurance, wet tensile and conditioned tensile strengths were the tests that were carried out. Wet tensile tests were run immediately after excess water was blotted from test sheets which had been removed after four hours immersion in distilled water. Otherwise, this test was the same as the ASTM standard tensile test for a conditioned sheet.

TABLE I

TEST RESULTS COMPARING SCMP SHEETS DRIED BY THE TAPPI PROCEDURE WITH HIGH TEMPERATURE PRESS DRIED (HTPD) SHEETS

| Drying Procedure | Time at 232° C. Press (secs) | Sheet Density (kg/M$^3$) | Conditioned Tensile Strength lb/in. (kN/m) | Wet Tensile Strength lb/in. (kN/m) | Double Fold |
|---|---|---|---|---|---|
| HTPD | 60 | 617 | 72.4(12.67) | 8.95(1.565) | 18 |
| HTPD | 20 | 645 | 72.6(12.70) | 7.53(1.317) | 14 |
| HTPD | 5 | 639 | 72.7(12.71) | 6.50(1.137) | 13 |
| TAPPI | — | 389 | 40.1(7.02) | 2.57(0.449) | 9 |

The improved tensile properties, both wet and conditioned, and the lowered brittleness as illustrated by the increased number of double folds, are in accordance with the invention.

EXAMPLE 2

A sample of a commercial low yield sulfite pulp in the never dried state, prepared from northern softwood chips, was obtained and converted to handsheets using a TAPPI mold. The quantity of fiber in the slurry fed to the mold was adjusted to give a basis weight of 42 lbs/1000 ft$^2$ (205 kg/M$^3$) in the oven dried state. Four sets of sheets were prepared and wet pressed as specified in accordance with the procedure in TAPPI T-205 om-81. Two of the four sets of sheet were dried on rings as required by the procedure. These sheets were considered to be dried by a conventional (C) method. One of the two sets of dry sheets was then subjected to heat treatment. For heat treatment, each sheet was placed between two 150 mesh stainless steel screens and inserted between the platens of a preheated platen press. Press temperatures of 392°, 428°, 454° F. (200°, 220° and 240° C.) were studied. The platens were immediately closed and 15 psi (103.4 kPa) pressure was applied for 5 seconds. Sheets were immediately removed from screens and allowed to cool after pressing.

Preliminary experiments using a thermocouple wire buried in the sheet showed the sheet internal temperature after 2 seconds is only 1°-2° C. lower than the platens temperature.

The third and fourth sets of sheets were placed between the 150 mesh screens and densified by a press densification (PD) procedure during the process of drying. To carry out the PD procedure, the wet sheets and the screens were placed between the platens of a second press and subjected to 15 psi (103.4 kPa) pressure at 138° C. for 5 seconds to dry surface fibers, after which the pressure was increased to 790 psi (5443 kPa) for 20 seconds. On completion of this PD process, sheet moisture was about 10%. One set of sheets was retained for testing. Each individual sheet and screens from the second set were removed from the PD press and immediately placed in the other, HT press for 5 seconds. HT press temperatures of 200°, 220° and 240° C. were studied. HT pressure was 15 psi (103.4 kPa). All sheets were conditioned at 22.5° C. for at least 48 hours before testing.

Fold and wet tensile strengths were determined as specified in Example 1.

TABLE II

EFFECT OF 5 SEC, 15 PSI (103.4 kPa) HEAT TREATMENT AT THREE TEMPERATURES ON SULFITE PULP HANDSHEET PROPERTIES

| Method of Drying | HT Temperature (°C.) | Sheet Density (kg/M$^3$) | Double Fold | Wet Tensile Strength lb/in. | Wet Tensile Strength kN/m |
|---|---|---|---|---|---|
| C | — | 702 | 979 | 2.86 | 0.500 |
| PD | — | 847 | 1467 | 5.09 | 0.891 |
| C + HT | 200 | 701 | 521 | 5.75 | 1.006 |
| PD + HT | 200 | 856 | 1337 | 7.56 | 1.323 |
| C + HT | 220 | 699 | 258 | 9.39 | 1.643 |
| PD + HT | 220 | 833 | 1038 | 13.13 | 2.300 |
| C + HT | 240 | 696 | 117 | 12.33 | 2.158 |
| PD + HT | 240 | 834 | 457 | 17.39 | 3.042 |

The results show that wet strength improves as heat treatment temperature is increased. Fold decreases as heat treatment temperature is increased, but the decrease is much less pronounced for the densified, heat treated sheets. This shows that the densified sheets are much less brittle than the conventional sheets, even after heat treatment to yield enhancement of wet strength. The data clearly shows that for a given heat treatment temperature, both wet strength and fold qualities of a press dried and heat treated sheet are superior to those of a like sheet only heat treated.

Inasmuch as the invention is subject to various changes and variations, the foregoing should be regarded as merely illustrative of the invention defined by the following claims.

We claim:

1. A method of minimizing the degradation of paperboard produced from semichemical-mechanical pulp while improving its wet strength by heat treatment, comprising steps of forming a wet web of cellulose fibers from an aqueous suspension of fibers; then, without first drying the web, press drying said wet web, by compressing it sufficiently to produce a product having a density of at least 700 kg/m$^3$ and drying the product until its water content by weight is less than 10%; and then heat treating the product at an internal temperature of at least 420° F. (216° C.) for a time sufficient to increase both the wet strength and folding endurance thereof as compared to a like product heat treated at the same temperature, but not press dried.

2. The method of claim 1, wherein said internal temperature is in the range of 420° F. (216° C.) to 572° F. (300° C.).

3. The method of claim 1, wherein said internal temperature is about 450° F. (232° C.).

4. The method of claim 1, wherein said densification includes applying sufficient pressure to the paper to produce density in range of 700–900 kg/m$^3$ prior to said heating step.

5. The method of claim 1, wherein said paper product is linerboard.

6. The method of claim 5, wherein said paperboard has a basis weight in the range of 125 to 464 g/m$^2$.

7. The method of claim 5, wherein said paperboard has a basis weight of about 203 g/m$^2$.

8. A paperboard of high wet strength and high folding endurance, produced according to any of claims 2, 3, 4, 5, 6, 7 or 1.

9. A paperboard as in claim 8, having a wet strength of at least 6 lb/in, and satisfying a folding endurance test of at least 10 cycles.

10. The method of claim 1, wherein said heat treating step is for a duration sufficient to produce a wet strength of at least 15 pounds per inch.

* * * * *